US005469970A

United States Patent [19]

Li

[11] Patent Number: 5,469,970

[45] Date of Patent: Nov. 28, 1995

[54] EASY OPEN STACKABLE HANDLE BAGS

[76] Inventor: Nam T. Li, 1808 S. Olive Ave., Alhambra, Calif. 91803

[21] Appl. No.: 254,072

[22] Filed: Jun. 3, 1994

[51] Int. Cl.[6] ..... B65D 27/10

[52] U.S. Cl. ..... 206/554; 383/37

[58] Field of Search ..... 206/554, 460; 383/37, 9

[56] References Cited

U.S. PATENT DOCUMENTS

| | | | |
|---|---|---|---|
| Re. 33,264 | 7/1990 | Baxley et al. | 206/554 |
| 3,380,579 | 4/1968 | Pinto | 206/554 |
| 4,423,819 | 1/1984 | Cummings | 206/807 |
| 4,796,759 | 1/1989 | Schisler | 206/554 |
| 4,904,092 | 2/1990 | Campbell et al. | 206/554 |
| 5,307,935 | 5/1994 | Kemanjian | 206/554 |
| 5,333,730 | 8/1994 | Boyd | 383/37 |
| 5,335,788 | 8/1994 | Beasley et al. | 206/554 |
| 5,363,965 | 11/1994 | Nguyen | 206/554 |

OTHER PUBLICATIONS

A pack of bags manufactured by Mobil Corporation, New York, N.Y.

A pack of bags manufactured by Sonoco Products Company, Hartsville, S.C.

A pack of bags manufactured by Cupples.

A pack of bags, manufacturers unknown.

*Primary Examiner*—Paul T. Sewell

*Assistant Examiner*—Marie Denise Patterson

*Attorney, Agent, or Firm*—Steven G. Roeder; Sheldon & Mak, Inc.

[57] ABSTRACT

A bag pack (10) of handle bags (14) for suspension on a bag rack (12) comprises a plurality of stackable handle bags (14) having a front wall (24), a rear wall (26), a pair of laterally spaced handles (28), and an adhesive (16) positioned between the rear wall (26) of each bag (14) and the front wall (24) of each successive bag (14) in the bag pack (10). The front wall (24) is joined opposite to the rear wall (26) and defines an enclosure having an open top (30), opposed sides (31), and a bottom (33). The handles (28) extend upwardly above the open top (30). Each bag (14) also has a center mount (34) capable of releasably supporting the center of the stackable bag (14) on the bag rack (12). The adhesive (16)is a non-toxic, water-based adhesive which preferably is over sixty percent (60%) water by volume, prior to application, between the bags (14) and is positioned proximate to the open top (30) and intermediate one of the sides (31) and the center mounts (34) to facilitate quick and reliable opening of successive bags (14) in the bag pack (10).

20 Claims, 1 Drawing Sheet

EASY OPEN STACKABLE HANDLE BAGS

BACKGROUND

The present invention relates to bag packs of stackable bags, commonly referred to as T-shirt bags, and a system for easily dispensing successive stackable bags from the bag pack.

Typically, checkout lines of grocery and department stores utilize paper or plastic bags for bagging the grocery and store items. To expedite the bagging process, individual plastic bags, neatly stacked in a bag pack for suspension on a bag rack are commonly used.

The bag rack usually has two outwardly extending, laterally spaced support arms and a center hook supporting the bags in the bag pack. The individual bags have laterally spaced handles with handle apertures extending therethrough for receiving the support arms and a removable center mount for receiving the center hook. Pin welds can be used to hold the individual bags together in the bag pack.

In operation, with the bag pack suspended by the support rack, the bagger prepares a bag for loading by pulling a front wall of the front bag in the bag pack away from the bag pack, separating the front wall from the center mount and any pin welds. In this position, the support arms which extend through the handle apertures support the bag during loading. Upon completion of loading the bag, the bag is removed from the support arms and the subsequent bag is pulled open on the support arms by the bagger. Such a bag pack dispensing system is disclosed in U.S. Pat. No. Re. 33,264 to Baxley, et al., and U.S. Pat. No. 5,074,674 issued to Kuklies, et al.

Because of the pin welds used to hold the bags in the bag pack and/or static charge between the individual bags in the bag pack, the bags in the bag pack are sometimes difficult to individually separate and open. Thus, the bagger's time is wasted grappling for the next bag. Accordingly, to expedite the bagging process, it has become important to make each subsequent individual bag of the bag pack open upon removal of the previous bag.

Prior art bag packs have attempted to solve this problem by attaching the rear wall of each bag in the bag pack to the front wall of the successive bag in the bag pack. Thus, when a bag is removed from the bag rack, the following bag is opened on the bag rack. For example, as disclosed in U.S. Pat. No. Re. 33,264 to Baxley, et al., an adhesive is used to attach the rear wall of each bag to the front wall of a successive bag. However, this approach has had limited success since frequently the adhesive does not easily disengage, causing subsequent bags to be pulled off of the bag rack before the adhesive bond is broken, or the adhesive bond breaks prior to the next bag being opened on the bag rack.

Accordingly, a need presently exists for an easy, quick, and reliable system to cause subsequent bags on a bag rack to be individually opened upon removal of the previous bag from the rack, thereby preventing the difficulty of opening the following bag.

SUMMARY

The present invention is directed to a bag pack used on a bag rack that meets these needs. A bag pack according to the present invention comprises a plurality of individual stackable handle bags and an area of releasable adhesive between each successive bag in the bag pack. As described below, successive bags from the individual bag pack are individually opened upon removal of the previous bag from the bag rack because of the unique positioning of the adhesive between the adjacent bags and the type of adhesive used.

Each bag has a front wall, a rear wall, and a pair of laterally spaced, upwardly extending handles. The front wall and rear wall are joined to form an enclosure having an open top, opposed sides and a bottom. The handles which are used for carrying the bag extend above and are positioned proximate to each side of the open top. Apertures extend through each handle to receive support arms of the bag rack and support the bags on the bag rack. A center mount integral with the front and rear walls is positioned at the open top between the two handles so that the bag is supported at three locations by the bag rack.

The area of releasable adhesive is located (i) between the rear wall of each bag and the front wall of each successive bag and (ii) intermediate the center mounts and one of the sides so that during the release of the center mount of the front wall of each subsequent bag from the bag rack, the adhesive bond between the previous bag and the subsequent bag in the bag pack is subject to a shear force. Preferably, the area of releasable adhesive is located closer to one of the sides than to the center mounts and positioned proximate to the open top to facilitate releasing of the center mount initially from one corner of the center mount.

In use, when the previous bag is being removed from the bag rack by a user, the adhesive positioned between one side of the bags and the center mounts causes the successive bag to be pulled by one side of the bag. When the successive bag is pulled by one side, the tearing of the center mount initiates from one corner of the center mount. The amount of force required to tear the center mount is less if tearing of the center mount initiates from one corner instead of both corners simultaneously. If the force required to tear the center mount is diminished, the bonding force required between adjacent bags can be reduced.

Optimally, the type of adhesive utilized has a high shear strength and poor peel strength. When the successive bag is pulled by one side, the adhesion bond between the bags is subject to a shear force during the release of the center mount. After the center mount is released from the front wall of the successive bag, the adhesive bond between the adjacent bags is subject to a tension force and is easily broken.

The present invention overcomes the disadvantages of prior art bag packs because the adhesive provides the proper adhesion between the bags and the positioning of the adhesive facilitates easy releasing of the center mount so that the adhesive bond required between adjacent bags to tear the center mount is reduced. Thus, the previous bag remains attached to the successive bag only until the successive bag is in the open position on the bag rack.

DRAWINGS

These and other features, aspects, and advantages of the present invention will become understood with the following description, current claims, and accompanying drawings where:

DESCRIPTION

Figure 2:
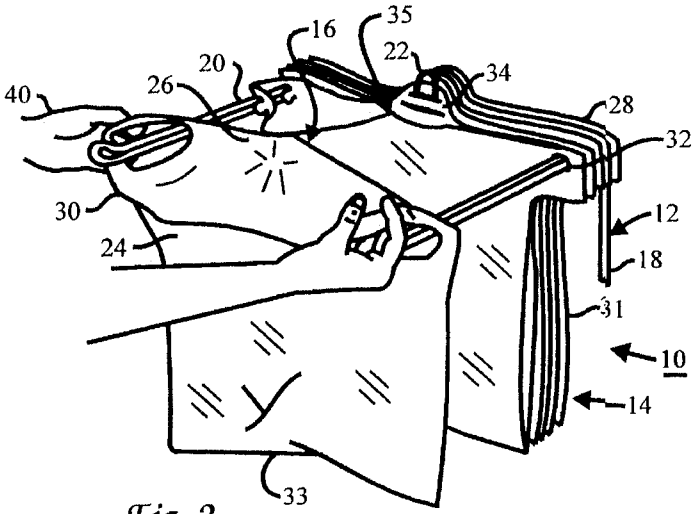
FIG. 2 is a perspective view of the bag pack of FIG. 1 with a selected bag open on the bag rack.

A bag pack 10 for use with a bag rack 12 according to the present invention comprises a plurality of aligned, individual, stackable handle bags 14 and an area of adhesive 16 between each bag 14 releasably attaching adjacent bags 14 in the bag pack 10. As described below, the unique positioning of area of adhesive 16 between adjacent bags 14 in the bag pack 10 and the type of adhesive 16 allows successive bags 14 to be opened upon removal of the previous bag 14. The bag pack 10, if used with a bag rack 12, provides a mechanism to automatically and consistently dispense individual handle bags 14 from the bag pack 10 quickly, efficiently, and with little effort.

The bag pack 10 is suspended from the bag rack 12, which typically comprises a frame 18 having a pair of laterally spaced, outwardly extending support arms 20. The bag rack 12 can further include a center hook 22 between the support arms 20. The bag rack 12 is well known in the industry, and it is described in further detail in U.S. Pat. No. Re. 33,264, issued to Baxley, et al., and U.S. Pat. No. 5,074,674, issued to Kuklies, et al.

With reference to the figures, each bag 14 has a front wall 24, a rear wall 26, and a pair of laterally spaced, upwardly extending handles 28. The front wall 24 and the rear wall 26 are joined to form an enclosure having an open top 30, opposed sides 31 and a bottom 33. The handles 28 are positioned on each side of the open top 30 and extend above the open top 30. A handle aperture 32 is disposed in each handle 28 so that each handle 28 can be supported by the respective lateral support arm 20 of the rack 12.

To provide additional support for the bags 14, a center mount 34 is positioned at the open top 30 between the handles 28, on each bag 14 for attachment on the center hook 22 of the bag rack 12. As shown in the drawing, the center mount 34 can be a detachable tab as described in U.S. Pat. No. Re. 33,264, having a mount aperture 36 for receiving the center hook 22 and a lower aperture 38 facilitating detachment of the center mount 34. Alternatively, the center mount 34 can be an aperture or slit as described in U.S. Pat. No. 5,074,674. The entire bag pack 10 is supported at these three points.

The bags 14 are preferably a lightweight, highly flexible, and strong thermoplastic material and are conventionally fabricated from a continuous plastic tube gusseted, flattened, and heat sealed at opposed upper and lower ends. The open top 30 of the bag is formed by a cutout inwardly and centrally through the upper portion of the bag 14. This cutout defines the center mount 34 and the pair of laterally spaced handles 28 formed in the upwardly extending portions of the front 24 and rear walls 26 of the bag respectively. Additionally, the sides 31 can be pleated (not shown) or the bottom 33 can be pleated (not shown).

The adhesive 16 preferably is an adhesive which has (i) a high shear strength on plastic, (ii) poor peel strength on plastic, (iii) a low viscosity allowing for ease of application and good distribution of the adhesive between the bags 14 and (iv) drys slowly allowing the adhesive to be placed between the bags early in the assembly process without concern of the adhesive drying prior to the bags being placed in the bag pack. For example, the adhesive 16 can be a water-based adhesive, such as Aqualock™ 8002 brand adhesive, manufactured by BF Goodrich, Adhesive Systems Division, 123 West Bartges Street, Akron, Ohio 44311-1081. Typically, the Aqualock™ 8002, brand adhesive prior to application is about 35% water by volume. The Aqualock™ 8002, brand adhesive takes about twelve (12) hours to dry and is not flammable, non-toxic and pressure sensitive. Further, the Aqualock™ 8002 upon application is a non-tacky adhesive which does not build up and cause gumming in the bag assembly equipment.

Figure 4:
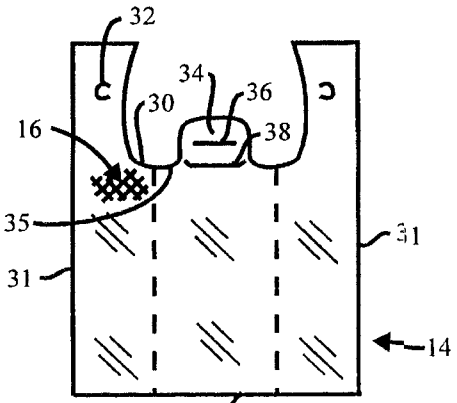
FIG. 4 is a front view of the bag pack of FIG. 1 prior to being mounted on a bag rack.
Figure 1:
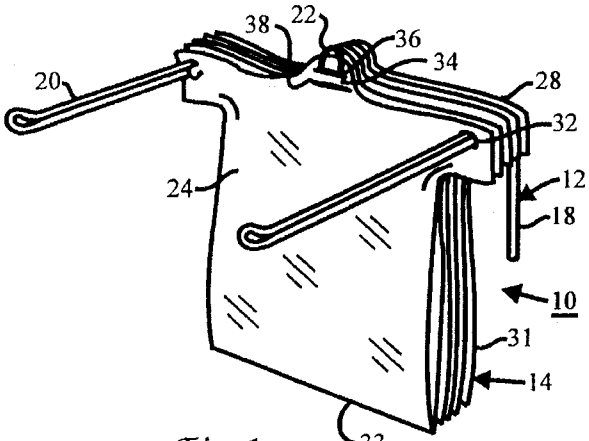
FIG. 1 is a perspective view of a bag pack mounted on a bag rack.

The physical property of the Aqualock™ 8002, brand adhesive are as follows:

Base: Acrylic
Color: Blue
Total Solids: 65%
Solvents: None—only water
Thinner: Water
Weight/Gallon: 8.5#/gallon (1.02 kg/liter)
Calculated Coverage: 1000 SF/Gal/Mil (24 $m^2$)/liter/0.254 mm)
Flash Point: None
Viscosity: 900–1800 cps #3 Brkfd@20 rpm
pH: 7–8
Precautions: Do Not Freeze The area of adhesive 16 is positioned between the rear wall 26 of each bag and the front wall 24 of each subsequent bag in the bag pack 10. The area of adhesive 16 is positioned intermediate the open tops 30 and the bottoms 33 of the bags and intermediate the center mounts 34 and one of the sides 31. Preferably the area of adhesive 16 is positioned closer to one side of the bags 31 than to the center mounts 34 and within the upper one-third (⅓) of the bags, and more preferably, proximate the open tops 30, so that when the previous bag 14 is removed from the bag pack 10, the front wall 24 subsequent bag 14 is pulled from one side 31 of the bag 14 by the previous bag. With reference to FIG. 4, the area of adhesive 16 is positioned about one-half (½) inch below the open tops 30 and about one (1) inch from the one side 31 of bags.

With reference to FIG. 2, when the previous bag 14 is pulled from the bag rack 12, the adhesive 16 between the adjacent bags 14 causes the front wall 24 of the successive bag 14 to be pulled from one side 31, initiating tearing of the center mount 34 from one corner 35 of the center mount 34. Less force is required to tear the center mount 34 from one corner 35 than tearing the entire center mount 34 simultaneously. If the force required to tear the center mount 34 is reduced, the strength of the adhesive 16 bond between the bags 14 can be reduced. Further, when the front wall 24 of the subsequent bag 14 is pulled from one side 31, the adhesive 16 between the previous and subsequent bags 14 is subject to a shear force. Since the adhesive 16 utilized preferably has a high shear strength, increased force is needed to separate the area of adhesion 16 subject to shear forces during the release of the center mount 34.

Figure 3:
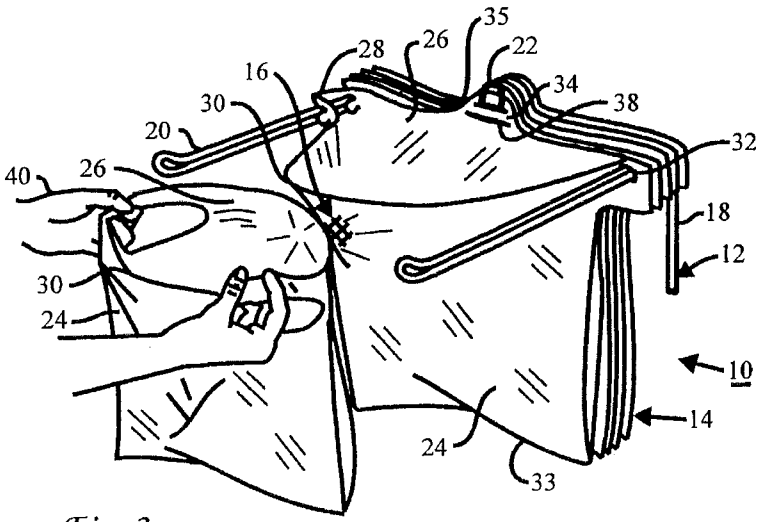
FIG. 3 is a perspective view of the bag pack of FIG. 1 with the selected bag removed from the bag pack and the subsequent bag ready for loading.

With reference to FIG. 3, after the center mount 34 is released, the area of adhesive 16 between adjacent bags 14 is subject to tension forces and easily separates after the successive bag 14 is opened since the adhesive preferably has a low peel strength.

The size and shape of the area of adhesive 16 varies according to the type of adhesive utilized. For the Aqualock™ 8002, brand adhesive the area of adhesive 16 can be an area between one-half (½) square inches to one and two and one-half (2½) square inches. However, the size and shape of the area of adhesive 16 varies according to the type of adhesive utilized and the location of the area of adhesive 16. For a given adhesive, larger areas of adhesive 16 have higher shear strengths than smaller areas of adhesive 16.

Optimally, water is added to dilute the Aqualock™ 8002, brand adhesive until the percentage is approximately 60% to 90% water by volume prior to application, so that the adhesive drys slowly and viscosity is low. The amount of Aqualock™ 8002, brand adhesive required between the bags 14 depends upon the percentage of water by volume. For example, if the Aqualock™ 8002, brand adhesive is diluted to about 60% water by volume, a small drop is sufficient. Additionally, a dye, i.e., green water ink, as sold by Graphic Science, located in Yorba Linda, Calif., can be added to the adhesive 16 to facilitate monitoring of the amount of adhesive 16 placed between the bags 14.

The adhesive 16 is typically placed on the front wall 24 of each bag 14 immediately before the bag 14 is placed in the bag pack 10. The adhesive 16 can be placed on each bag 14 by releasing a small drop or drops of adhesive 16 into a swab (not shown) which contacts the front wall 20 of each bag 14 prior to placing the bag 14 in the bag pack 10. If the adhesive 16 flows freely, an automatic oiler (not shown), part number 1065K14 as sold by McMaster-Carr, located at 600 County Line Road, Elmhurst, Ill. 60127, can be used to release a drop or drops of adhesive into the swab which contacts the front wall 24 in the appropriate place. The automatic oiler provides a way to easily adjust the flow rate of the adhesive 16 so that a single drop or plurality of drops can be released upon the front wall 24 of the bags 14. Further, the oiler can have a solenoid which automatically closes the flow of adhesive in the event the assembly of the bags 14 stops.

Alternatively, a spray nozzle (not shown) can be used to apply the adhesive 16 on the front wall 24 of each bag 14. In this version, a reservoir (not shown) containing the adhesive 16 and in fluid communication with the spray nozzle is pressurized and a solenoid valve positioned between the reservoir and the spray nozzle selectively opens or closes flow to the spray nozzle, applying the adhesive onto the front wall 24 at the appropriate time.

In use, the bag pack 10 is placed on the bag rack 12 with the support arms 20 extending through handle apertures 32 and the center hook 22 extending through the center mount 34. A user 40 pulls outward on the front wall 24 of the previous bag 14, forcing the center mount 34 to release and an individual bag 14 to slide outwardly on the support arms 20, opening the bag 14 and allowing for filling of the bag 14. At this time, the handles 28 are still supported by the support arms 20. After the bag 14 is filled, the user 40 pulls the handles 28 off of the support arms 20 and removes the filled bag 14 from the bag rack 12. Since the rear wall 26 of the previous bag 14 is attached to the front wall 24 of the subsequent bag 14 with the adhesive 16, the subsequent bag 14 is moved to the open position upon removal of the prior bag 14.

The positioning and type of adhesive 16 utilized aids in the removal of the subsequent bag 14. Since the adhesive 16 is positioned near one side 31 of the bags 14, the front wall 24 of the subsequent bag 14 is pulled from one side 31, thereby (i) tearing the center mount 34 from one corner 35 (i.e., significantly reducing the amount of force required to release the center mount 34) and (ii) causing the adhesive 16 between adjacent bags to be in subject to shear forces. After the center mount 34 releases, the adhesive 16 between adjacent bags 14 is largely subject to tension force, and is easily separated.

Although the present invention has been described in considerable detail with reference to certain preferred versions, many other versions should be apparent to those skilled in the art. For example, an alternate adhesive having poor peel strength and good shear strength can be utilized. Therefore, the spirit and scope of the appended claims should not necessarily be limited to the description of the preferred versions contained herein.

What is claimed is:

1. A bag pack of stackable handle bags suitable for suspension by laterally spaced support arms of a bag rack, the bag pack comprising:

(a) a plurality of aligned, stackable handle bags, each handle bag having (i) a front wall having a longitudinal axis, (ii) a rear wall having a longitudinal axis, the rear wall joined opposite to the front wall defining an enclosure having an open top, opposed sides and a bottom, (iii) a pair of laterally spaced handles integral with the front and rear walls extending upwardly from the open top, each handle having a handle aperture extending therethrough for receiving a support rod, and (iv) a releasable center mount attached to the front and rear walls of each stackable handle bag on the longitudinal axis of the front and rear walls for receiving a center hook on the bag rack, the center mount releasably supporting each respective handle bag; and (b) an area of releasable adhesive positioned at an offset area located (i) between the rear wall of each handle bag and the front wall of each subsequent handle bag in the bag pack, (ii) intermediate the longitudinal axis of the front and rear walls and only one of the opposed sides of the bags, and (iii) closer to the open top than the bottom so that when each handle bag is removed from the bag rack by its handles and during the release of the center mount of the front wall of each subsequent bag from the bag rack, the front wall of each subsequent bag is pulled only from the offset area;

wherein the force required to release the releasable adhesive is greater than the force required to release the center mount when the front wall is pulled from the offset area;

wherein when each handle bag is removed from the bag rack by its handles and after the center mount is released the front wall of each subsequent bag, the force required to release the area of adhesive is less than the force required to continue to pull the subsequent bag by its front wall.

2. The bag pack of claim 1, wherein the adhesive includes a dye so that the area of adhesive between the bags can be easily monitored.

3. The bag pack of claim 1, wherein the offset area is positioned closer to one of the opposed sides of the bags than to the longitudinal axis of the front and rear walls.

4. The bag pack of claim 3, wherein the area of adhesive between the bags is positioned proximate to the open top of the bags.

5. The bag pack of claim 1, wherein the adhesive is water based.

6. The bag pack of claim 5, wherein the water-based adhesive comprises over 60 percent water by volume prior to application between the bags.

7. The bag pack of claim 1, wherein the bag is made from a thermoplastic material.

8. The bag pack of claim 1 wherein the center mount includes opposed corners and when each handle bag is removed from the bag rack by its handles, the release of the center mount of the front wall of each subsequent bag from the bag pack initiates from the opposed corner closest to the area of adhesive.

9. The bag pack of claim 1 wherein the adhesive has a shear strength which is greater than its peel strength.

10. The bag pack of claim 9 wherein the area of adhesive is at least ½ square inches.

11. The bag pack of claim 9 wherein the area of adhesive is at least 1 square inches.

12. The bag pack of claim 9 wherein the area of adhesive is at least 2 square inches.

13. A bag pack of stackable handle bags suitable for suspension by laterally spaced support arms of a bag rack, the bag pack comprising:

(a) a plurality of aligned stackable handle bags, each handle bag having (i) a front wall having a longitudinal axis, (ii) a rear wall having a longitudinal axis, the rear wall joined opposite to the front wall defining an enclosure having an open top, opposed sides and a bottom, (iii) a pair of laterally spaced handles integral with the front and rear walls extending upwardly from the open top, each handle having a handle aperture extending therethrough for receiving a support rod, and (iv) a releasable center mount attached to the front and rear walls of each stackable handle bag on the longitudinal axis of the front and rear walls for receiving a center hook on the bag rack, the center mount releasably supporting each respective handle bag, and each center mount having opposed corners; and (b) an area of releasable adhesive positioned at an offset area located (i) between the rear wall of each handle bag and the front wall of each subsequent handle bag in the bag pack, (ii) intermediate the longitudinal axis of the front and rear walls and only one of the opposed sides of the bags, and (iii) intermediate the open top and the bottom of the bags, so that when each handle bag is removed from the bag rack by its handles, and during the release of the center mount of the front wall of each subsequent bag from the bag rack, the front wall of each subsequent bag is pulled only from the offset area and the release of the center mount initiates from the corner closest to the area of adhesive;

wherein the force required to release the releasable adhesive is greater than the force required to release the center mount when the front wall is pulled from only the offset area;

wherein when each handle bag is removed from the bag rack by its handles and after the center mount is released the front wall of each subsequent bag, the force required to release the area of adhesive is less than the force required to continue to pull the subsequent bag by its front wall.

14. The bag pack of claim 13, wherein the offset area is positioned proximate the open top of the bags and closer to one of the opposed sides of the bags than to the longitudinal axis.

15. The bag pack of claim 14, wherein adhesive is water-based having a shear strength which is greater than its peel strength and the area of adhesive is at least ½ square inches.

16. The bag pack of claim 15, wherein the water-based adhesive and the area of adhesive is at least 1 square inches.

17. The bag pack of claim 13, wherein the adhesive includes a dye so that the adhesive between the bags can be easily monitored.

18. A bag pack of stackable handle bags suitable for suspension by laterally spaced support arms of a bag rack, the bag pack comprising:

(a) a plurality of aligned stackable handle bags, each handle bag having (i) a front wall having a longitudinal axis, (ii) a rear wall having a longitudinal axis, the rear wall joined opposite to the front wall defining an enclosure having an open top, opposed sides and a bottom, (iii) a pair of laterally spaced handles integral with the front and rear walls extending upwardly from the open top, each handle having a handle aperture extending therethrough for receiving a support rod, and (iv) a releasable center mount attached to the front and rear walls of each stackable handle bag on the longitudinal axis of the front and rear walls for receiving a center hook on the bag rack, the center mount releasably supporting each respective bag, and each center mount having opposed corners; and (b) an area of releasable, water-based adhesive having a shear strength which is greater than its peel strength positioned at an offset area located (i) between the rear wall of each handle bag and the front wall of each subsequent handle bag in the bag pack, (ii) proximate to the open top of the bags and (iii) intermediate the longitudinal axis of the front and rear walls and one of the opposed sides of the bags, so that when each handle bag is removed from the bag rack by its handles, and during the release of the center mount of the front wall of each subsequent bag from the bag rack, the front wall of each subsequent bag is pulled from the offset area and the release of the center mount initiates from the corner closest to the area of adhesive;

wherein the force required to release the releasable adhesive is greater than the force required to release the center mount when the front wall is pulled from the offset area;

wherein when each handle bag is removed from the bag rack by its handles and after the center mount is released the front wall of each subsequent bag, the force required to release the area of adhesive is less than the force required to continue to pull the subsequent bag by its front wall.

19. The bag pack of claim 18, wherein the area of water-based adhesive comprises over 60 percent water by volume prior to application between bags and the area of adhesive is at least ½ square inches.

20. The bag pack of claim 18, wherein the adhesive includes a dye so that the area of adhesive between the bags can be easily monitored.

* * * * *